United States Patent [19]

Forshee

[11] 4,366,905

[45] Jan. 4, 1983

[54] PLASTIC MATERIAL HANDLING RACK

[75] Inventor: David J. Forshee, Oxford, Mich.

[73] Assignee: Syn-Trac Systems Inc., Oxford, Mich.

[21] Appl. No.: 246,725

[22] Filed: Mar. 23, 1981

[51] Int. Cl.[3] ..... B65D 6/24; B65D 21/02; B65D 19/18; B65D 19/32

[52] U.S. Cl. ..... 206/511; 206/512; 206/600; 206/821; 220/1.5; 220/4 F; 220/84

[58] Field of Search ..... 206/507, 509, 511, 512, 206/513, 600; 220/1.5, 4 F, 84

[56] References Cited

U.S. PATENT DOCUMENTS

| | | | |
|---|---|---|---|
| 2,595,685 | 12/1951 | Loose | 206/512 |
| 3,401,814 | 9/1968 | Chiswell | 220/4 F |
| 3,459,326 | 8/1969 | Befjemann | 206/512 |
| 3,651,977 | 3/1972 | Morgan | 206/512 |
| 3,796,340 | 2/1974 | Piggott | 220/4 F |
| 3,865,239 | 2/1975 | Herolzer | 206/507 |
| 3,985,258 | 10/1976 | Quigley | 20/4 F |
| 3,989,157 | 11/1976 | Ueenema | 220/84 |
| 4,174,045 | 11/1979 | Heller | 206/512 |

FOREIGN PATENT DOCUMENTS

| | | | |
|---|---|---|---|
| 1423603 | 11/1965 | France | 220/4 F |
| 1580243 | 11/1980 | United Kingdom | 206/513 |

*Primary Examiner*—George E. Lowrance
*Attorney, Agent, or Firm*—Benjamin W. Colman

[57] ABSTRACT

A plastic material handling rack adapted to receive and translate small or relatively large parts or units, capable of being stacked vertically one rack upon another, and to be loaded by conventional fork lift trucks into transportation vehicles. The plastic material handling rack is assembled with corner posts, side rails and end rails that form the unit into a rectilinear framework. A floor plate is removably attachable to the framing. Transverse rails are attached to the side or end rails for support of larger machine units or devices, and solid or perforated side walls are attachable to the corner posts and upon the side rails and end rails, converting the open framework of the rack into a tub rack.

22 Claims, 12 Drawing Figures

PLASTIC MATERIAL HANDLING RACK

BACKGROUND OF THE INVENTION

This invention pertains to a plastic material handling rack having an adaptability to receive and translate parts or relatively large machine units, to be stacked vertically one rack upon another, and to be loaded into transportation vehicles such as trailers, trucks and railroad cars.

Heretofore, racks designed for carrying heavy components such as automobile engines, axles, transmissions, pumps, and other similar relatively heavy units have been built of steel. Many of these steel racks weigh well over 500 pounds and can only be moved or lifted by power-driven lift trucks.

Steel tubs, also of substantial weight, have been used in the past for carrying a large plurality of small parts of relatively small unit weight, but constituting a heavy load when such large plurality is placed in a tub rack. Steel tub racks are designed and built differently from steel racks which carry heavy components such as engines, transmissions, etc. Steel tub racks cannot be converted into engine carrying racks, nor can the latter be converted into tub racks.

Because of the substantial weight and frangibility of steel racks, their maintenance and repair costs are relatively high and, in industrial plants, relatively frequent. For safety reasons, many of these racks must be color coded, i.e., painted in a color readily visible to personnel moving about in the area of the racks. Because of the polluted atmosphere in most industrial plants or relatively severe atmospheric conditions outside of the plants, in which these racks are moved or stored respectively, the painting film applied to the steel is relatively shortlived, requiring frequent fresh coating applications.

In industrial locations, where steel racks are often piled one upon the other (and not always carefully stacked for safe support), accidents have occurred in which personnel have been injured as a result of being struck by one or more of the racks which have toppled from their elevated positions.

SUMMARY OF THE INVENTION

This invention relates to a plastic load-carrying material handling rack which is adaptable to translating individual heavy components or units as well as, with slight modification, pluralities of small parts. The rack of this invention is easily assembled with conventional fasteners such as bolts and nuts. The rack framing accepts rails for supporting individual heavy machine units or components as well as a base panel and side and end wall panels to form a tub rack for carrying small, lighter parts.

The plastic parts-carrying rack of this invention generally comprises corner posts secured in rectilinear upright corner positions by, to and between side and end rails respectively, for the retention and securement of a bottom or floor plate therebetween and for attachment of side and end wall panels of solid or imperforate design and construction to be removably affixed to elements of the corner post. The plastic rack is constructed with or without a floor plate, and in the latter condition, longitudinally or transversely extending rails are attachable to and between the end or side rails respectively for support of relatively heavy engine or other machine components or units.

The plastic rack of this invention is preferably made of a plastic super tough nylon or polymer material such, for example, as DuPont's Zytel ST nylon. The plastic may in some instances be reinforced with fiberglas filaments to impart added tensile strength to the plastic polymer.

Many advantages reside in the inventive construction. These include very substantial weight reduction in the rack permitting higher net loads of material to be carried in trucks and railroad cars, which normally have a weight load limit. For example, the rack disclosed herein to carry 4 transmission assemblies has a tare weight of about 80 pounds in contrast to the 550 pound tare weight of currently used steel racks for the same number of units. Another advantage resides in the impact resistance of the plastic rack with no damage to the parts being carried thereon. Maintenance and repair of the plastic rack is much less costly and more rapidly effected because a damaged or broken element of the inventive rack can be quickly and easily replaced by removing the fasteners which secure the damaged part and replacing the same with a new identical or substantially identical replacement part, in a matter of minutes. This, in contrast to torch cutting a damaged steel part from the rack, cutting, machining and fitting a new replacement part, and rewelding the latter to the rack, time-consuming, specialized-labor operations being required.

Other advantages include one-time color coding the plastic for safety purposes in contrast to repeated painting of steel racks. The plastic coloring is effected throughout and no repeat coloring is required. Further, the plastic rack has a higher material-carrying capability because of its lower weight. The rack moves easily on skid bars attached to the side and/or end rails which elevate the base plates at the corner posts slightly above the floor plane on which the rack rests. Because of the rack's light weight it will bounce away upon impact against another rack, part, machine or other obstacle. Damage to the rack in most cases is negative or trivial.

It has been found that a rack fully loaded with four heavy transmission units can be pushed across a concrete floor manually, by virtue of the skid bars attached to the side and end rails. This advantage is not present in steel racks. Two men can easily lift and translate a plastic rack of this invention from one location to another in contrast to the requirement for a lift truck to move a steel rack.

These and other objects and advantages of the invention will become more apparent by reference to the following detailed specification to be read in context with the attendant drawings.

DETAILED DESCRIPTION OF THE PREFERRED EMBODIMENTS

Figure 1:
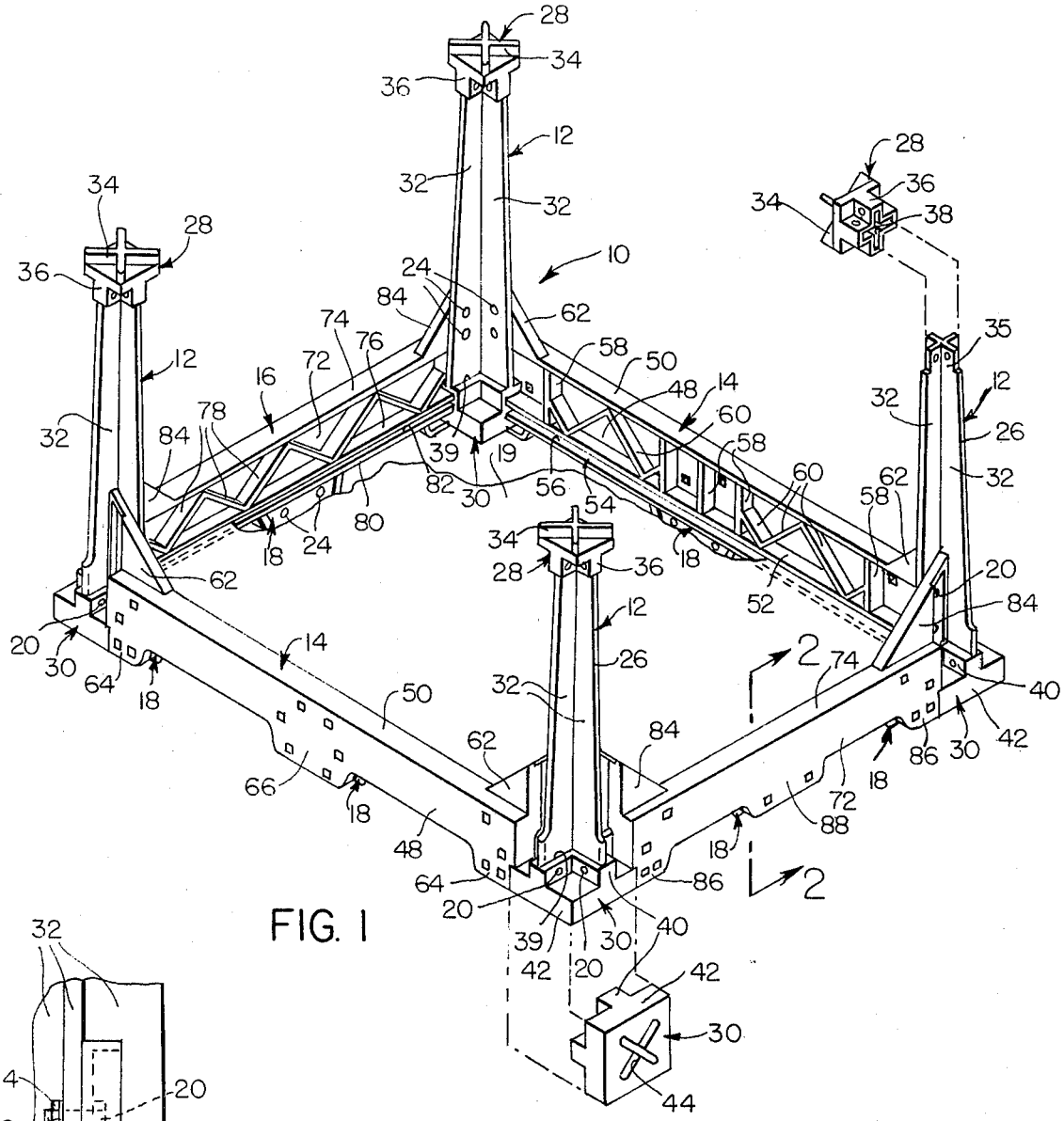
FIG. 1 is a perspective view of a plastic material handling rack, constituting a preferred embodiment of the invention.
Figure 2:
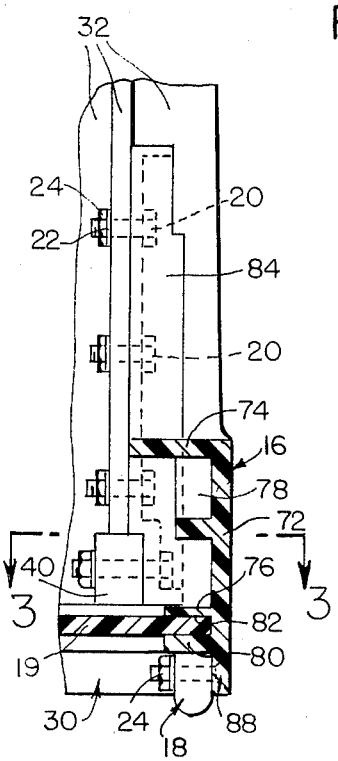
FIG. 2 is a fragmentary vertical elevational view partially in section taken substantially on the line 2—2 of FIG. 1.
Figure 3:
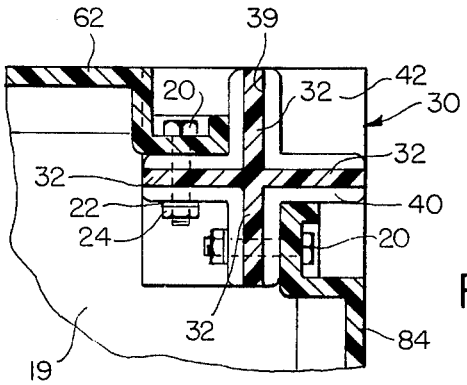
FIG. 3 is a fragmentary horizontal sectional view taken substantially on the line 3—3 of FIG. 2.

The plastic rack 10 illustrated in FIG. 1, a preferred embodiment of the invention, comprises the plastic corner posts 12, the plastic side rails 14, the two plastic end rails 16, and the plastic skid bars 18 secured to the side and end rails. A plastic base or floor plate 19 is optionally combined with these component elements. Conventional fasteners such as the bolts 20 secure the side and end rails 14 and 16 to the corner posts 12 with washers 22 and prevailing torque lock nuts 24.

Each of the corner posts 12 comprises a corner body 26 of cruciform cross-sectional design, a stacking cap 28 also of cruciform cross-sectional design, and a base plate 30.

The cruciform elements or members 32 of the corner body 26 extend laterally at right angles to each other from a common axis. Although the members 32 are shown to extend longitudinally in a tapering design, such taper is not essential.

The stacking cap 28 comprises an upper male cruciform projection 34 and a lower depending cruciform sheath 36. As shown particularly in FIG. 1, the sheath or projection 36 is provided with a cruciform recess 38 complementary to and adapted to receive and seat the upper distal cruciform end 35 of the corner post body 26. The stacking cap 28 is secured to the corner body 26 by conventional bolt, washer and prevailing torque lock nut assemblies. The lower end 37 of the cruciform corner body 26 is seated in the cruciform recess 39 of the upstanding cruciform member or sheath 40 of the base plate 30. The body 42 of the base plate is provided on its underside with a cruciform recess 44 complementary with and adapted to seat the male cruciform portion 34 of the stacking cap 28. Note will be taken that the cruciform portion 34 of the stacking cap is at 45 degrees to the base plate body 42 and its recess 44. The aforesaid bolt, washer and prevailing torque lock nut elements 20, 22 and 24 respectively are used to secure the cruciform body 26 to the base plate 30 through the cruciform elements 32.

The side rails 14 each comprises a body portion 48, an inwardly directed top flange 50, an inwardly directed intermediate flange 52, an inwardly directed lower flange 54 spaced from and below the intermediate flange 54 to provide a longitudinally extending recess or pocket 56 therebetween to receive and seat the floor panel 19. The side rail member 14 is further provided with stiffening and bracing elements such as the vertical members 58 and the angular braces 60 between the upper flange 50 and the intermediate flange 52. The side rails are also provided with distal end bracing panels 62, 62 which are secured to aligned cruciform elements 32 of aligned corner posts 12. The side rail body 48 is further provided with depending body portions 64, 64 at its distal ends and the body portion 66 in its intermediate area. The depending portions 64, 64, 66 extend below the lower flange 54 of the side rail. The skid bars 18 are attached to and inwardly of these depending portions by the conventional fasteners described above.

Figure 4:
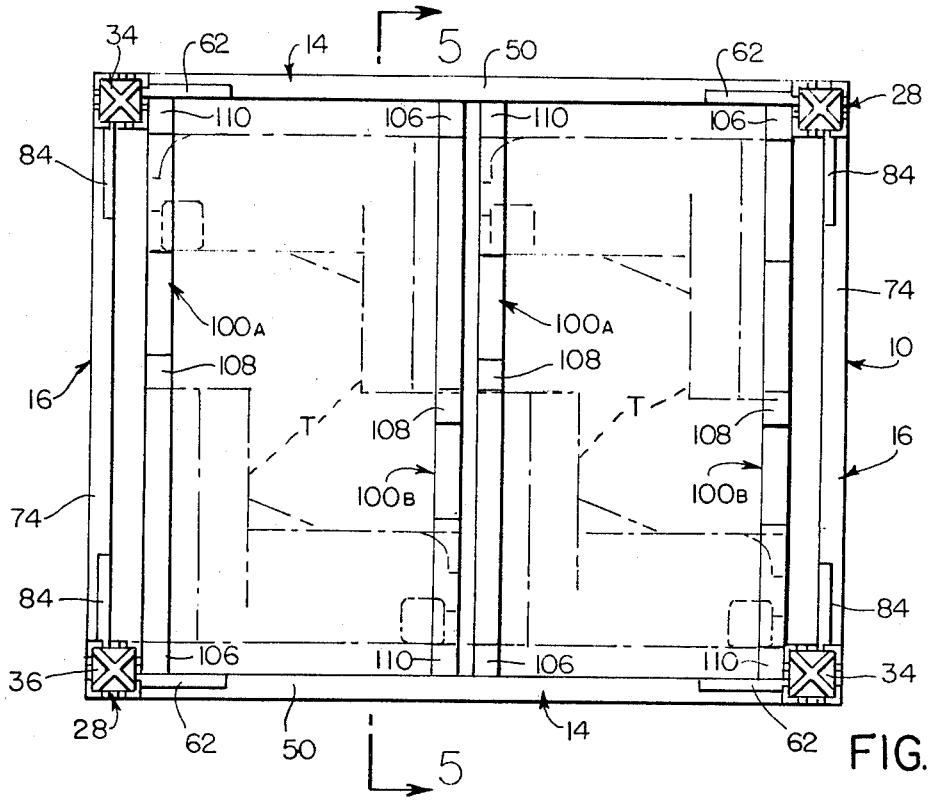
FIG. 4 is a top plan view of the rack embodiment illustrated in FIG. 1, showing two pair of automobile transmission assemblies (in broken lines) seated in transverse supporting rails secured to side members of the rack.
Figure 5:
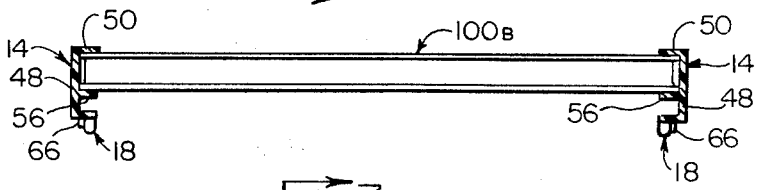
FIG. 5 is a transverse vertical sectional view taken substantially on the line 5—5 of FIG. 4.
Figure 6:
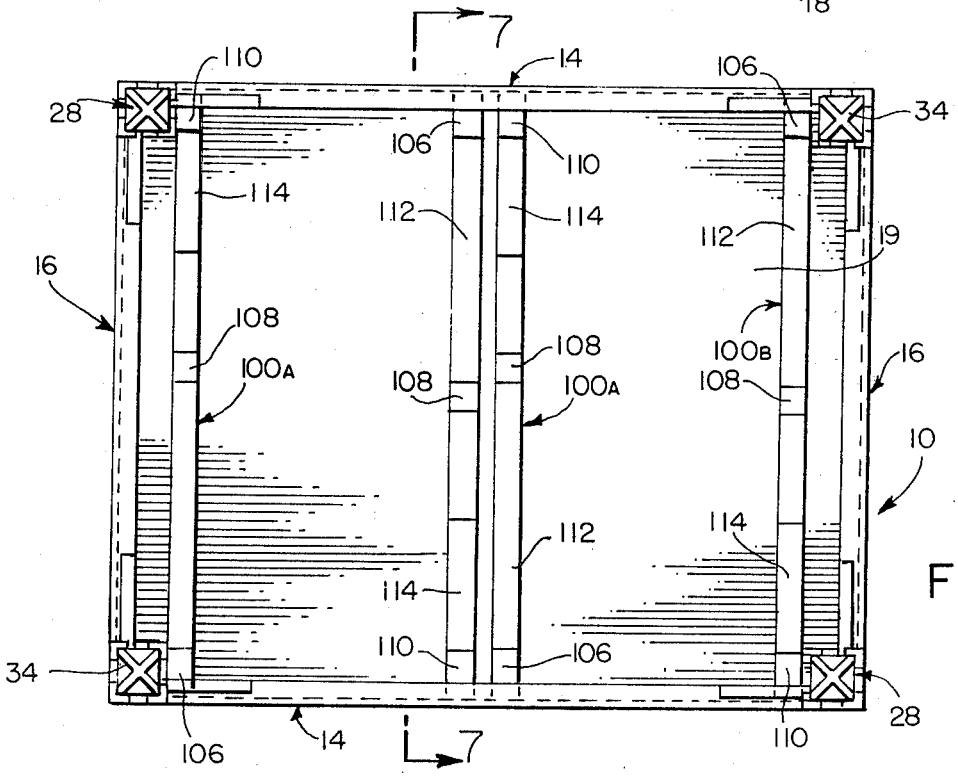
FIG. 6 is another top plan view, similar to that illustrated in FIG. 4, including a base or floor plate as a component element of the rack illustrated in FIG. 1.
Figure 7:
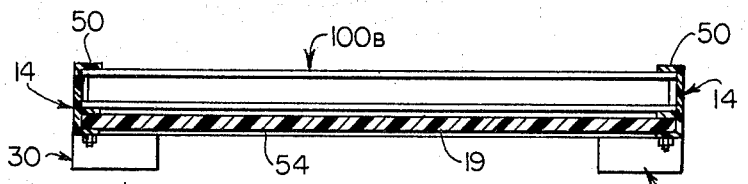
FIG. 7 is a vertical sectional view taken substantially on the line 7—7 of FIG. 6.
Figure 9:
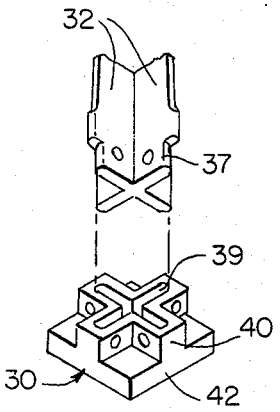
FIG. 9 is a perspective exploded view showing the cruciform bottom end of a corner post in bottom perspective and the top of a base plate for connection thereto in top perspective.
Figure 8:
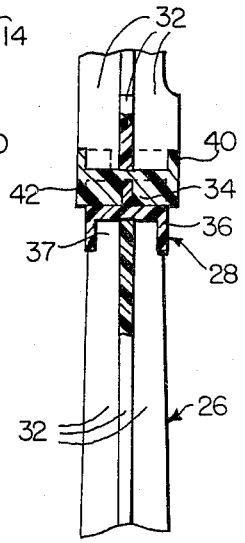
FIG. 8 is a fragmentary vertical elevational view, partially in section, taken at a conjunction of stacked corner posts.
Figure 12:
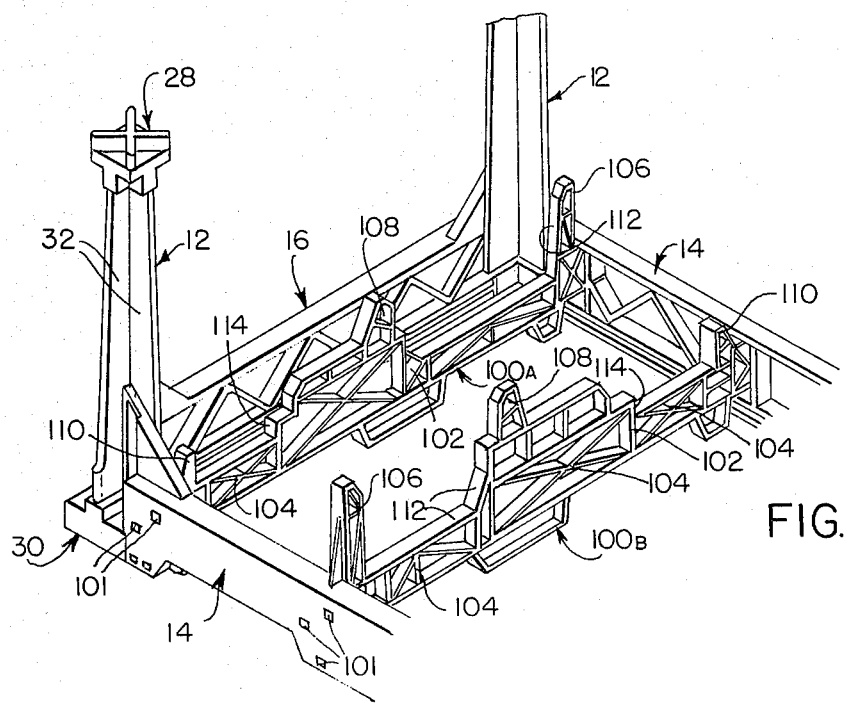
FIG. 12 is a fragmentary perspective view showing a pair of transverse load-supporting rails, as illustrated in FIG. 4, affixed to side members of the rack illustrated in FIG. 1.

The side rail body 48 is perforated with fastener openings 68 adapted to receive and pass carriage bolts or other screws for securement of transverse rails as described below (FIGS. 4, 6, 12).

The end rails 16, 16 are each substantially similarly provided with a body portion 72 having an inwardly directed top flange 74, an inwardly directed intermediate flange 76, a plurality of brace members 78, an inwardly directed lower flange 80 spaced from and below the intermediate flange 76 to form and provide a floor plate receiving and seating recess or pocket 82 therebetween, distal end bracing panels 84, 84 and body portions 86, 86 and 88 depending below the lower flange 80. These depending portions have skid bars 18 secured to their inwardly facing surfaces. The end rails 16, 16 are secured to aligned corner post cruciform elements 32 with conventional bolts, washers and prevailing torque lock nuts.

The skid bars 18 are so mounted on the depending portions 64, 64, 66 of the side rails and the depending portions 86, 86, 88 of the end rails that their lower edges lie in a plane slightly below the bottom plane of the base plates 30. These skid bars, whose lower edges are preferably rounded or arcuate in cross-sectional view, provide merely a line contact with the ground plane upon which they rest.

As illustrated particularly in FIGS. 4, 6 and 12, the rack 10 is provided in combination with a pair of transverse rails 100A, 100B (identical in design and construction) arranged in parallel and reversed relationship for support of machine components such for example as automobile transmission units T. Two pairs of the rails 100A, 100B are secured to the side rails 14, 14 as illustrated in FIGS. 4 and 6. Each transverse rail is provided with end panels which abut the inner surfaces of the side rail bodies 48, 48 and are there secured by suitable fasteners 101, such for example as carriage bolts and nuts, to the side rails. To make efficient use of the space in the rack, the units T are arranged in reversed attitude on and between the transverse rails. Each of these rails is provided with a body portion 102, suitable bracing elements 104, upstanding posts 106, 108, 110 adjacent to recesses 112 and 114 respectively in which the units T rest.

It will be understood by persons skilled in the art to which the invention pertains that these load-bearing transverse rails will or can be modified to suit particular devices or components required to be carried by the rack. For instance, engines, rear axles, pump units, fans, motors and other units of substantial weight can be carried in these racks by the application and attachment of suitable complementary transverse rails.

Figure 10:
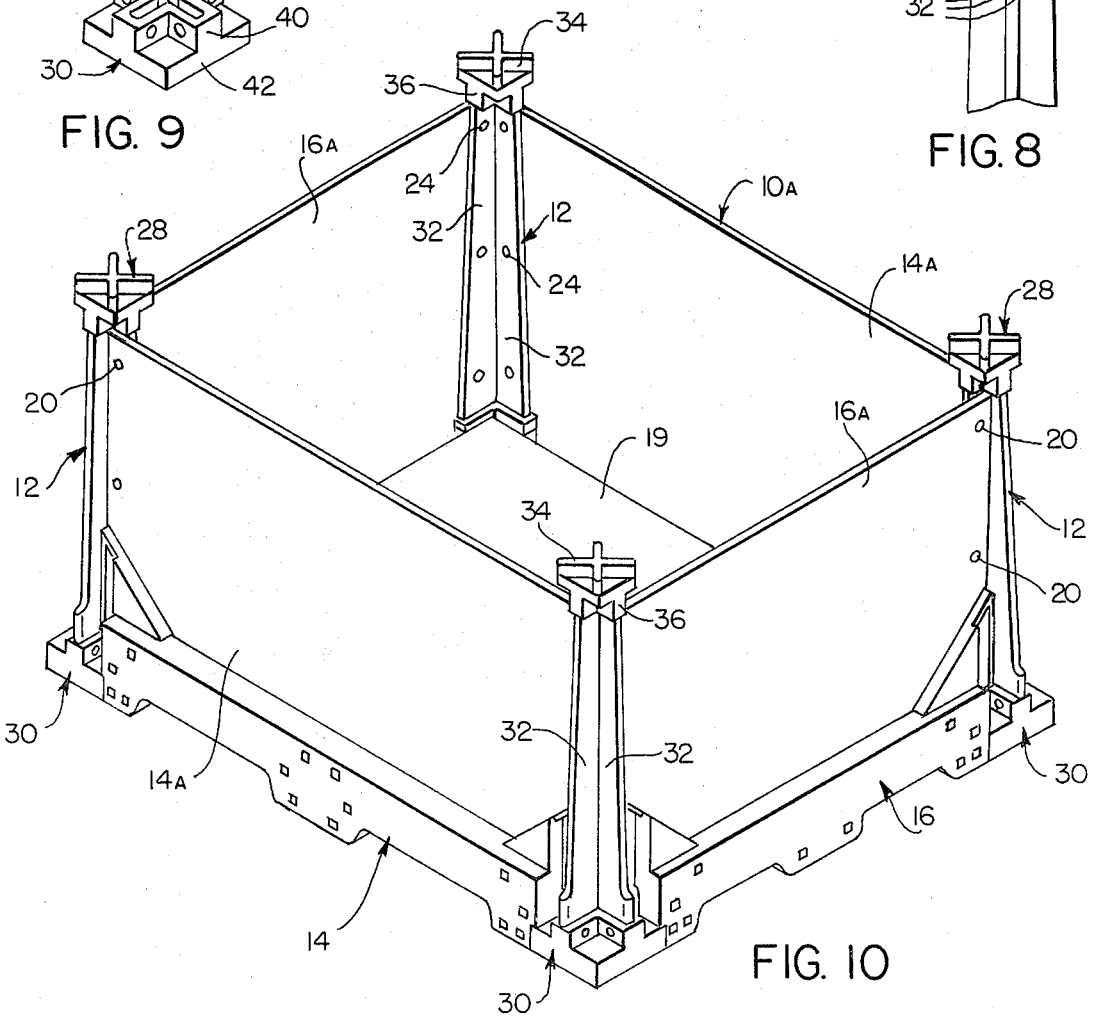
FIG. 10 is a perspective view similar to that illustrated in FIG. 1 showing the plastic rack having solid side and end walls to form a tub rack.

The rack 10 can be converted into a tub rack 10A by attaching solid plastic panel side and end walls 14A and 16A respectively to the aligned spaced apart cruciform elements 32 of the corner posts 12 by bolt, washer and prevailing torque lock nuts 20, 22 and 24 respectively, as shown particularly in FIG. 10.

Figure 11:
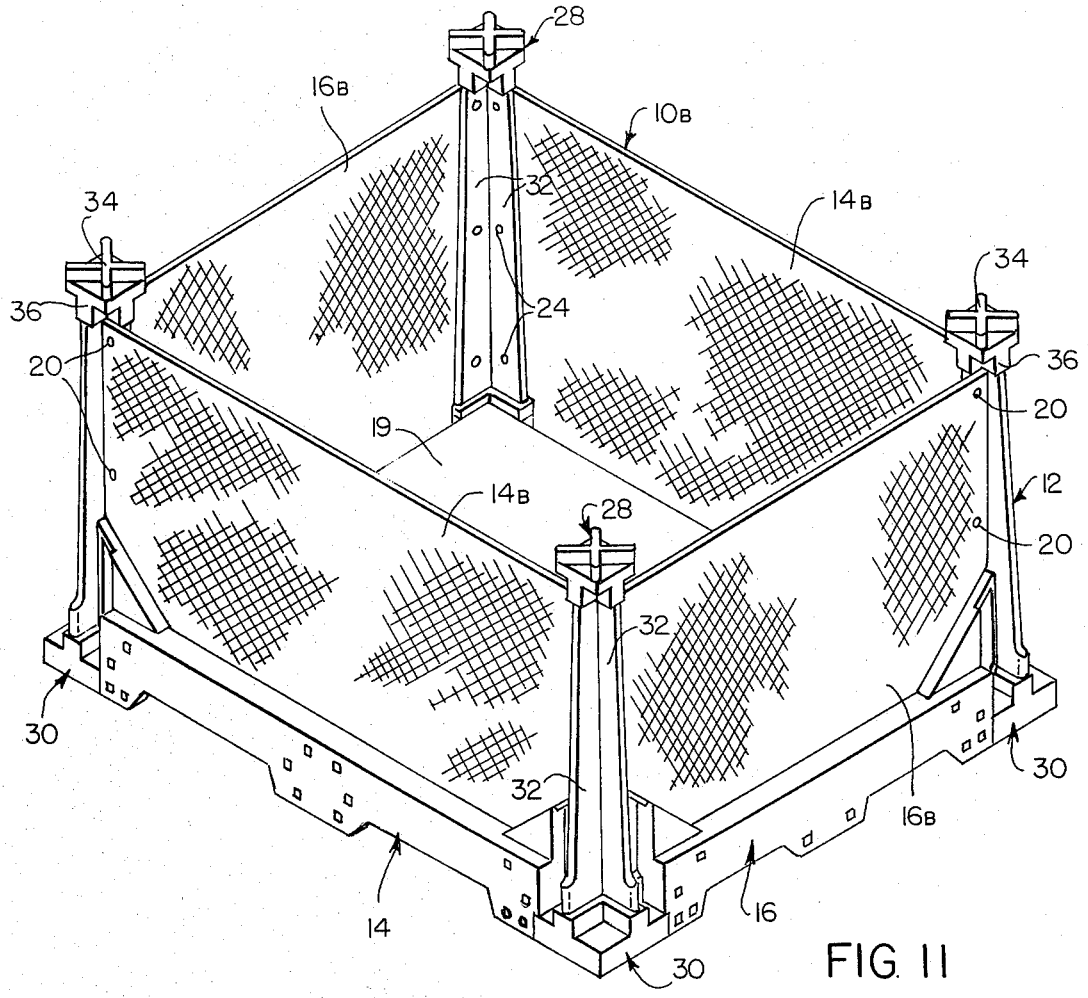
FIG. 11 is a view similar to FIG. 10 showing side and end walls of imperforate design forming another tub rack.

An alternate form of tub rack 10B is that illustrated in FIG. 11, wherein the rack 10 is provided with perforated, screen-type side and end panels 14B and 16B of plastic material attached to contain and translate pluralities of small unit parts.

The skid bars 18 are preferably molded of a plastic nylon polymer material and function as wear bars. Their replacement after extended wear against the ground plane upon which they rest and are moved is the least expensive component of the racks 10, 10A and 10B. These skid or wear bars are removably secured preferably to inner surfaces of the lower depending portions 64, 64, 66 and 86, 86, 88 of the side and end rails respectively.

Each of the component elements of the rack structures 10, 10A and 10B, including but not limited to the corner posts, side rails, end rails, stacking caps, base plates, floor plate, skid bars, side walls, end walls, and transverse load-supporting rails, are preferably fabricated or molded of Zytel ST nylon polymer material, a product produced by E. I. DuPont de Nemours & Co. (Inc.) of Wilmington, Delaware 19898. This plastic material can be mixed with a fiberglass concentrate to add further strength to the material. The amount of such fiberglass additive is proportional to the weight load anticipated to be carried by the racks. If the load or weight requirements of the racks increase, the percentage of fiberglass filaments used with the nylon resin is also increased. Although the bolts, washers and prevailing torque lock nuts which secure the principal rack component elements together are preferably made of metal, these or similar fastener components may also be made of a suitable plastic material to meet the needs of specific applications.

Having disclosed herein certain particular preferred embodiments of the invention for purposes of explanation, further modifications or variations thereof, after study of this specification, will or may occur or become apparent to persons skilled in the art to which the invention pertains. Reference should be had to the appended claims in determining the scope of the invention.

I claim:

1. A plastic stackable rack of relatively low weight in comparison with steel and of relatively high load-carrying capability comprising in combination a plurality of unitary molded plastic corner posts, a pair of unitary molded plastic side rails removably conjoined to said corner posts, a pair of unitary molded plastic end rails removably conjoined to said corner posts and forming a rectilinear frame with said corner post conjoined side rails, a unitary molded plastic stacking cap removably affixed to the upper end of each of said corner posts, a unitary molded plastic base plate removably affixed to the lower end of each of said corner posts, each said base plate having a recess in the bottom surface thereof to receive and seat at least the upper projecting end of a stacking cap, and means removably securing said side and end rails and said stacking caps and base plates to said corner posts, assembling said rack for its load-carrying capability.

2. The plastic rack defined in claim 1, wherein each said corner post has a longitudinally extending cruciform cross-sectional configuration.

3. The plastic rack defined in claim 2, wherein said cruciform cross-sectional configuration is tapering outwardly downwardly from its upper distal end.

4. The plastic rack defined in claim 1, wherein each said side rail and end rail has a body portion having substantially horizontal inwardly directed upper, intermediate and lower flanges arranged in spaced apart, parallel relationship.

5. The plastic rack defined in claim 4, wherein said side rail and end rail intermediate and lower flanges define a floor plate receiving recess or slot therebetween.

6. The plastic rack defined in claim 5, wherein said rack combination includes a floor plate disposed in said recesses.

7. The plastic rack defined in claim 1, wherein each said side rail and end rail has a body portion having substantially horizontal inwardly directed upper and lower flanges arranged in spaced apart, parallel relationship.

8. The plastic rack defined in claim 7, wherein each said side rail and end rail is provided with bracing members disposed between said upper and lower flanges.

9. The plastic rack defined in claim 4, wherein each said side rail and end rail is provided with bracing members disposed between said upper and intermediate flanges.

10. The plastic rack defined in claims 4 and 7, wherein each said side rail and end rail is provided with a bracing member at each distal end extending upwardly from said upper flange for attachment to said corner posts.

11. The plastic rack defined in claim 10, wherein each said distal end upwardly extending bracing member is secured to aligned spaced apart corner post cruciform elements.

12. The plastic rack defined in claim 1, including skid bars removably attached to said framing at the lower portions thereof.

13. The plastic rack defined in claim 12, wherein the lower edges of said skid bars lie substantially in a plane below the plane(s) of said base plates and said side and end rails, whereby said skid bar lower edges rest upon the ground plane.

14. The plastic rack defined in claim 1, wherein said skid bars are removably secured to and on inner surfaces of said framing.

15. The plastic rack defined in claims 1 and 2, wherein each said stacking cap comprises a body portion, a cruciform member projecting upwardly from one side of said body portion, and a cruciform recess in the opposite side of said body portion, the cruciform member and the cruciform recess being axially aligned and parallel, said cruciform member being disposed at a 45° offset with respect to said cruciform recess.

16. The plastic rack defined in claim 15, wherein said cruciform recess is complementary to and seats the corner post upper distal end, said stacking cap body portion being secured to said corner post upper distal end.

17. The plastic rack defined in claim 15, wherein each said base plate comprises a body portion, a first cruciform recess in the upper surface of said body portion complementary to and adapted to receive and seat the corner post lower distal end, and a second cruciform recess in the bottom surface of said body portion complementary to and adapted to receive and seat a stacking cap upwardly projecting cruciform member, said first and second cruciform recesses being axially aligned and parallel, said second cruciform recess being disposed at a 45° offset with respect to said first cruciform recess.

18. The plastic rack defined in claim 5, including a plastic unitary substantially planar floor plate, said floor plate being disposed in said recesses or slots of said side and end rails between said intermediate and lower flanges.

19. The plastic rack defined in claim 1, wherein said rack assembling securing means comprises at least bolts and prevailing torque lock nuts of metallic or plastic materials.

20. The plastic rack defined in claim 1, including unitary molded plastic transverse load-supporting and carrying rails secured to said side and end rails, said transverse rails comprising a body portion, and upstanding components or elements defining recesses therebetween to receive and seat and secure portions of load units to be translated by said rack.

21. The plastic rack defined in claim 18, including solid imperforate plastic side and end wall panels secured to said corner posts, forming an enclosure and a tub rack with said plastic floor plate.

22. The plastic rack defined in claim 18, including perforated plastic side and end wall panels secured to said corner posts, forming an enclosure and a tub rack with said plastic floor plate.

* * * * *